US007131554B2

(12) United States Patent
Hashimoto

(10) Patent No.: US 7,131,554 B2
(45) Date of Patent: Nov. 7, 2006

(54) TABLET FEEDER

(75) Inventor: Hiroshi Hashimoto, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 172 days.

(21) Appl. No.: 10/486,897

(22) PCT Filed: Aug. 19, 2002

(86) PCT No.: PCT/JP02/08340

§ 371 (c)(1),
(2), (4) Date: Feb. 17, 2004

(87) PCT Pub. No.: WO03/016138

PCT Pub. Date: Feb. 27, 2003

(65) Prior Publication Data

US 2004/0195261 A1 Oct. 7, 2004

(30) Foreign Application Priority Data

Aug. 20, 2001 (JP) ..... 2001-249341

(51) Int. Cl.
*B65H 1/00* (2006.01)
*B65G 59/00* (2006.01)

(52) U.S. Cl. ..... 221/197; 221/258; 221/287

(58) Field of Classification Search ..... 221/258, 221/154, 263, 287, 265, 277, 197; 400/625
See application file for complete search history.

(56) References Cited

U.S. PATENT DOCUMENTS 5,768,658 A * 6/1998 Watanabe et al. ..... 399/111
6,029,032 A * 2/2000 Watanabe et al. ..... 399/111
6,035,159 A * 3/2000 Azuma et al. ..... 399/111
6,068,158 A * 5/2000 Chabout ..... 221/113
6,073,799 A * 6/2000 Yuyama et al. ..... 221/154
6,123,329 A * 9/2000 Sato et al. ..... 271/9.01
6,128,454 A * 10/2000 Kawai et al. ..... 399/116
6,201,935 B1 * 3/2001 Terada et al. ..... 399/13

(Continued)

FOREIGN PATENT DOCUMENTS

GB 537 659 7/1941

(Continued)

*Primary Examiner*—Kathy Matecki
*Assistant Examiner*—Rakesh Kumar
(74) *Attorney, Agent, or Firm*—Wenderoth, Lind & Ponack, L.L.P.

(57) ABSTRACT

A tablet feed having a drive transmission composed of a drive gear 7 that is interlocked with the rotating shaft of a motor 6, a driven gear 13 that is interlocked with a rotor 9, and an intermediate gear 14 made up of a first gear section 15 that gears with the drive gear 7 and a second gear section 16 that gears with the driven gear 13. At least a gear ratio of the second gear section 16 to the first gear section 15 of the intermediate gear 14 is made small so as to prevent tablets in other pocket sections 10 adjacent to a pocket section 10 open to a discharge port 11 from falling from the discharge port 11 when a tablet housing case 4 is detached from a case support base 3. This makes it possible to prevent tablets from falling down when the tablet housing case is detached from the case support base.

3 Claims, 7 Drawing Sheets

U.S. PATENT DOCUMENTS 6,331,001 B1 * 12/2001 Sekiguchi ..... 271/9.01
6,336,018 B1 * 1/2002 Kawai et al. ..... 399/117
6,349,848 B1 * 2/2002 Uema et al. ..... 221/6
6,394,308 B1 * 5/2002 Yuyama et al. ..... 221/265
6,501,927 B1 * 12/2002 Watanabe et al. ..... 399/117
6,516,168 B1 * 2/2003 Shiratori et al. ..... 399/103
6,530,706 B1 * 3/2003 Sugimoto et al. ..... 400/625
6,829,455 B1 * 12/2004 Yasumoto et al. ..... 399/167
6,836,629 B1 * 12/2004 Miyabe et al. ..... 399/111
6,901,229 B1 * 5/2005 Nishiuwatoko et al. ..... 399/167

FOREIGN PATENT DOCUMENTS

JP 9-232702 12/1997
JP 10-314277 12/1998
JP 2000-43801 2/2000
JP 3040396 3/2000
JP 2000-203502 7/2000

* cited by examiner

TABLET FEEDER

BACKGROUND OF THE INVENTION

1. Technical Field

The present invention relates to a tablet feeder.

2. Description of Related Art

As a tablet feeder, there has conventionally been one that is composed of a case support base on which a motor is provided and a tablet housing case attachable to and detachable from the case support base. This type of tablet feeder is structured such that drive of the motor rotates a rotor disposed in the tablet housing case via a plurality of gears so as to discharge tablets held in the pockets of the rotor from a discharge section.

When a tablet is supplied to a tablet housing case, the tablet housing case should be temporarily detached from the case support base. In this case, the rotor comes into a rotatable state, and so the tablets housed therein might fall down. Accordingly, in order to prevent automatic rotation of the rotor and discharge of the tablet, there has been proposed a structure for preventing rotation of the rotor by pressing a plate spring and the like to the gear that is interlocked with the rotor (see Japanese Patent Gazette No. 3040396, Japanese Patent Laid-Open Publication No. 10-314277, and Japanese Patent Laid-Open Publication No. 2000-43801 for reference).

Further, when the tablet housing case is detached from the case support base, tooth bearing of the gear on the case support base side and the tablet housing case side is changed, which sometimes causes slight rotation of the rotor. In this case, depending on the stop position of the rotor, tablets held in the pockets may be discharged from the discharge section.

Accordingly, in order to prevent rotation of the rotor when the tablet housing case is detached from the case support base, there has been proposed a structure having an elastic engagement member which engages with the gear that is interlocked with the rotor to prevent the rotor from rotating when the tablet housing case is detached from the case support base (Japanese Patent Laid-Open Publication No. 9-323702).

However, the above-described conventional structures require a plate spring and an elastic engagement member, which complicates the structure and causes increased costs. Moreover, in the state that the tablet housing case is attached to the case support base, force always acts upon the plate spring and the elastic engagement member, so that the long-term use thereof may disable the plate spring and the elastic engagement member from sufficiently fulfilling the role of preventing rotation of the gear. Furthermore, when the tablet housing case is detached from the case support base, it is not possible to avoid the rotation of the gear before the force from the plate spring and the elastic engagement member acts thereon.

SUMMARY OF THE INVENTION

Accordingly, it is a primary object of the present invention to provide a tablet feeder capable of thoroughly preventing tablets from falling down when a tablet housing case is detached from a case support base despite a simple structure.

As a means to accomplish the above object of the present invention, there is provided a tablet feeder characterized by driving a motor provided in a case support base, rotating a rotor disposed inside a tablet housing case via drive transmission means, moving tablets housed in the tablet housing case to a discharge section in the state of being held in each pocket section of the rotor, and discharging the tablets from the discharge section.

The drive transmission means comprises: a drive gear that is interlocked with a rotating shaft of the motor; a driven gear that is interlocked with the rotor; and an intermediate gear composed of a first gear section that gears with the drive gear and a second gear section that gears with the driven gear, and at least a gear ratio of the second gear section to the first gear section in the intermediate gear is made small so as to prevent tablets in other pocket sections adjacent to a pocket section open to the discharge section from falling down from the discharge section when the tablet housing case is detached from the case support base.

According to this structure, even if the teeth of the drive gear presses and rotates the teeth of the first gear section of the intermediate gear when the tablet housing case is detached from the case support base, the driven gear can rotate only in the range smaller than that of the drive gear due to the difference in gear ratio with the second gear section. Therefore, with a simple structure having only an intermediate gear that is composed of the first gear section and the second gear section different from each other in gear ratio, it becomes possible to thoroughly prevent the tablets from falling down.

Further, as a means to accomplish the above object of the present invention, there is provided a tablet feeder characterized by driving a motor provided in a case support base, rotating a rotor disposed inside a tablet housing case via drive transmission means including a plurality of gears, moving tablets housed in the tablet housing case to a discharge section in the state of being held in each pocket section of the rotor, and discharging the tablets from the discharge section.

The drive transmission means comprises: a driven gear that is interlocked with the rotor; a worm gear that gears with the driven gear; a slide shaft that is disposed slidably along a shaft center of the worm gear and that rotates integrally with the worm gear; and a drive section that is integrated with a rotating shaft of the motor and that engages with and disengages from one end portion of the slide shaft to a shaft center direction.

According to this structure, when the tablet housing case is attached to and detached from the case support base, the drive section that is integrated with the rotating shaft of the motor engages with and disengages from the slide shaft from the shaft center direction, so that rotation of the worm gear is prevented. Therefore, the rotor will not rotate via the driven gear, making it possible to thoroughly prevent the tablets from falling down. Moreover, even if the drive section and the slide shaft do not engage with each other when the tablet housing case is attached to the case support base, the slide shaft is slid and engaged with the drive section by rotation of the motor. Therefore, attachment of the tablet housing case is accomplished by one smooth operation, making it possible to ensure engagement between the drive section and the slide shaft.

DETAILED DESCRIPTION OF THE INVENTION

Embodiments of the invention will now be described with reference to the accompanying drawings.

First Embodiment

Figure 1:
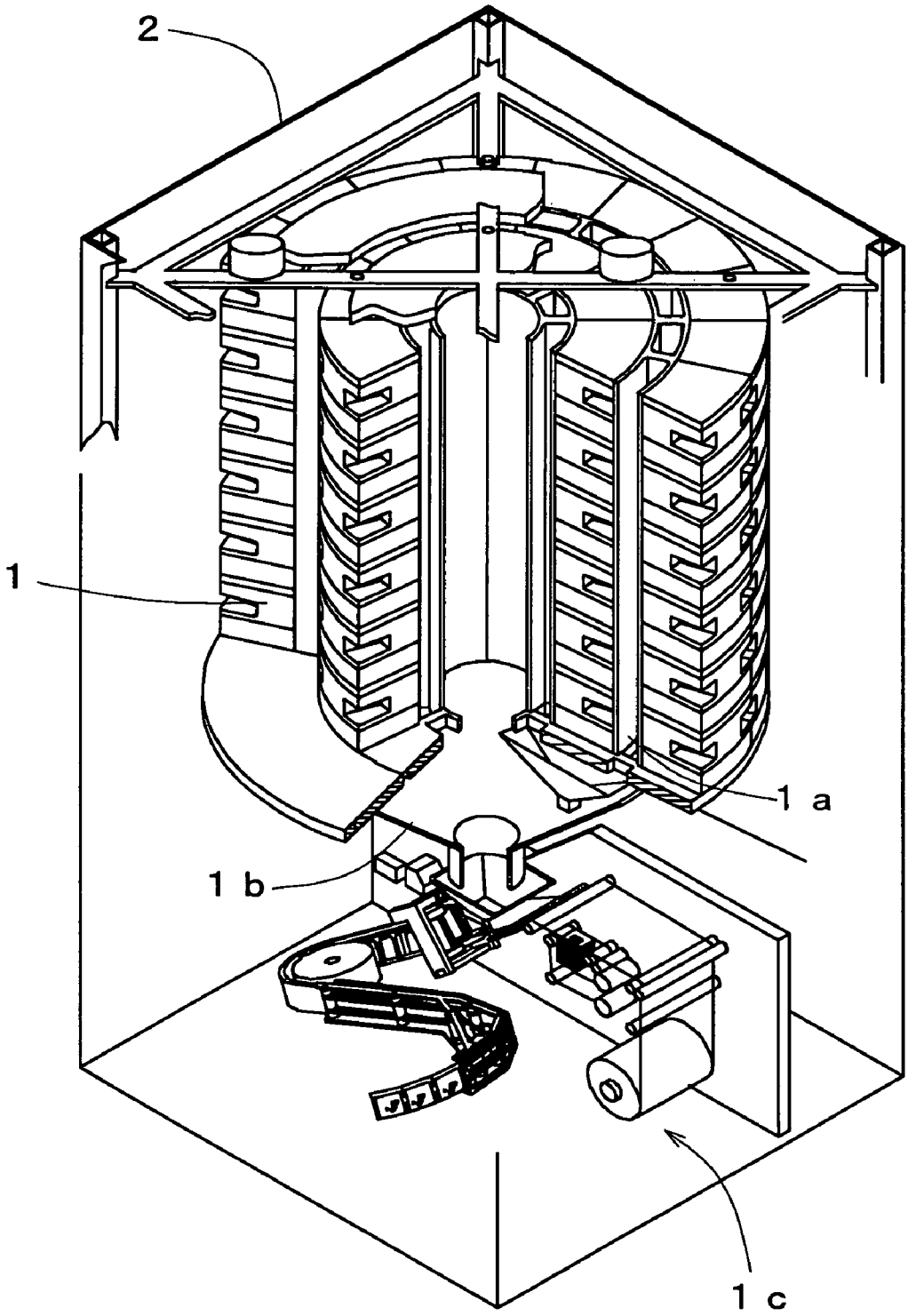
FIG. 1 is a perspective view showing a tablet feeding apparatus having a tablet feeder according to a first embodiment.

FIG. 1 shows tablet feeders 1 according to the first embodiment in the state of being attached to respective case support bases 3 disposed in a cylindrical shape inside a tablet feeding apparatus 2. Tablets discharged from each of the tablet feeders 1 travel through a pathway 1*a* extending in the vertical direction, and are collected in a hopper 1*b* below and packed one by one by a packing unit 1*c*.

Figure 2:
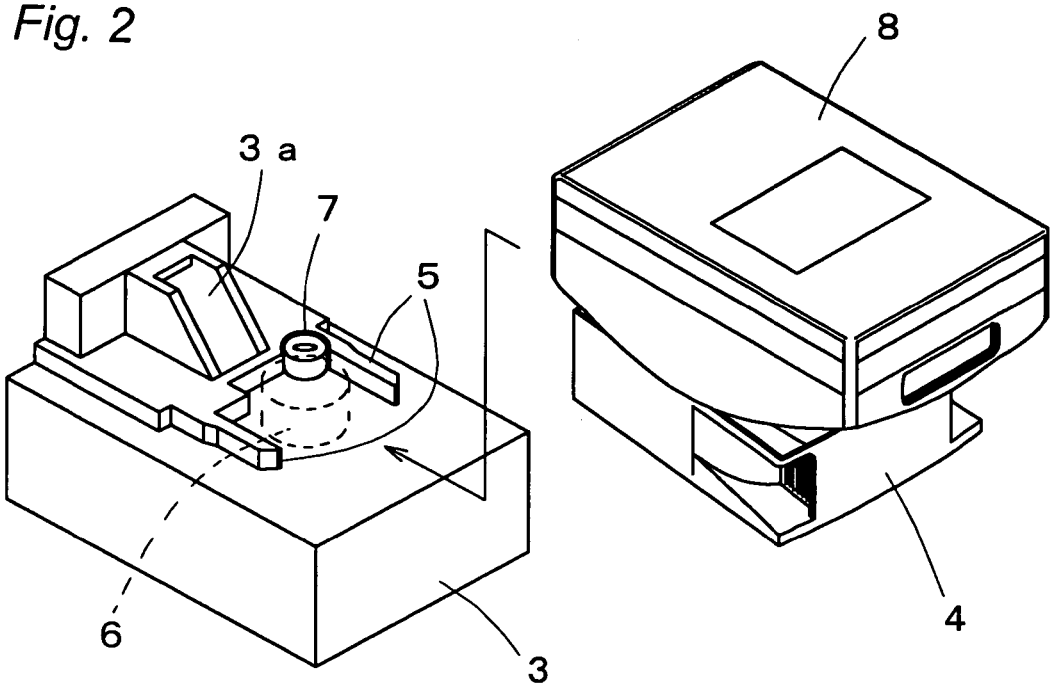
FIG. 2 is an exploded perspective view showing the tablet feeder according to the first embodiment.

As shown in FIG. 2, the tablet feeder 1 has a tablet housing case 4 attachable to and detachable from the case support base 3 provided in the tablet feeding apparatus 2.

Figure 3:
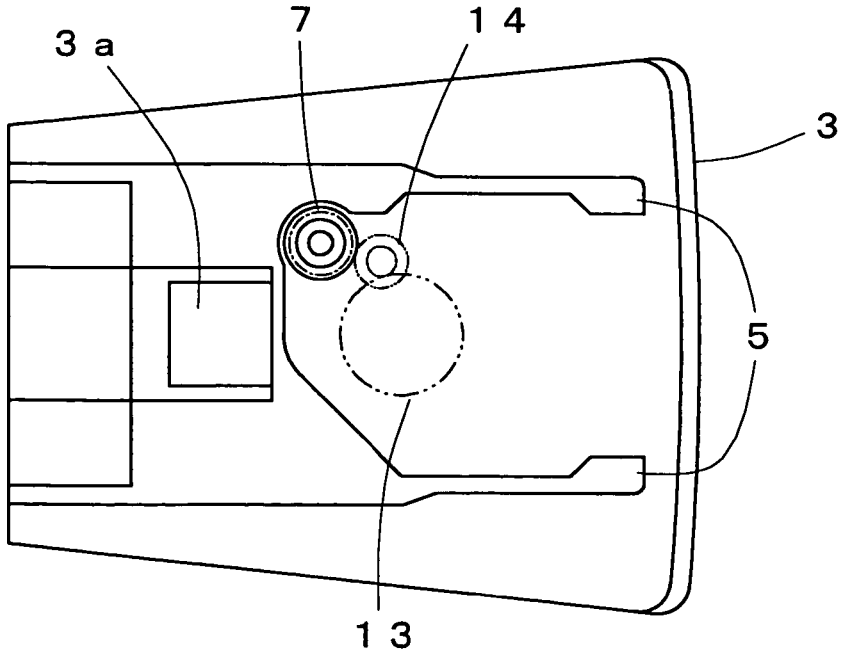
FIG. 3 is a plan view showing a case support base illustrated in FIG. 2.

As shown in FIG. 3, the case support base 3 is structured such that guide sections 5 are disposed in parallel on its upper surface with a specified space therebetween. Further, in the case support base 3, there is housed a motor 6 that is subject to drive control based on a control signal from an a control unit (not shown). The rotating shaft of the motor 6 protrudes above the upper face of the case support base 3, and the protruded portion is integrated with a drive gear 7. As the drive gear 7, there is used, for example, a spur gear with a module of 0.8 and 13 teeth. Also in the case support base 3, there is formed a discharge pathway 3*a* linked to the pathway 1*a*, where a sensor (not shown) for detecting passing tablets is provided.

Figure 4:
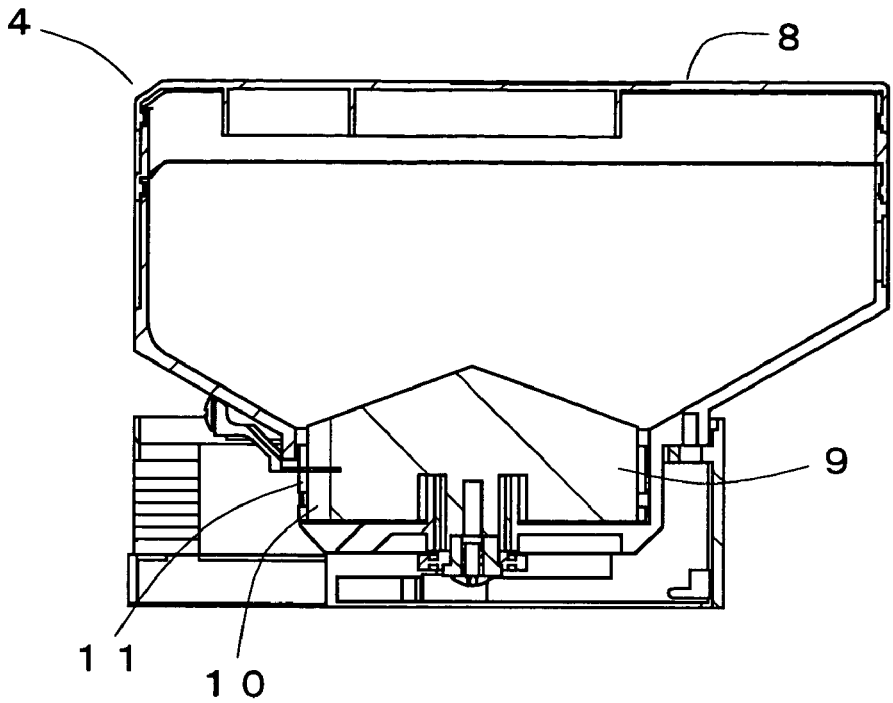
FIG. 4 is a cross sectional view showing a tablet housing case illustrated in FIG. 2.
Figure 5:
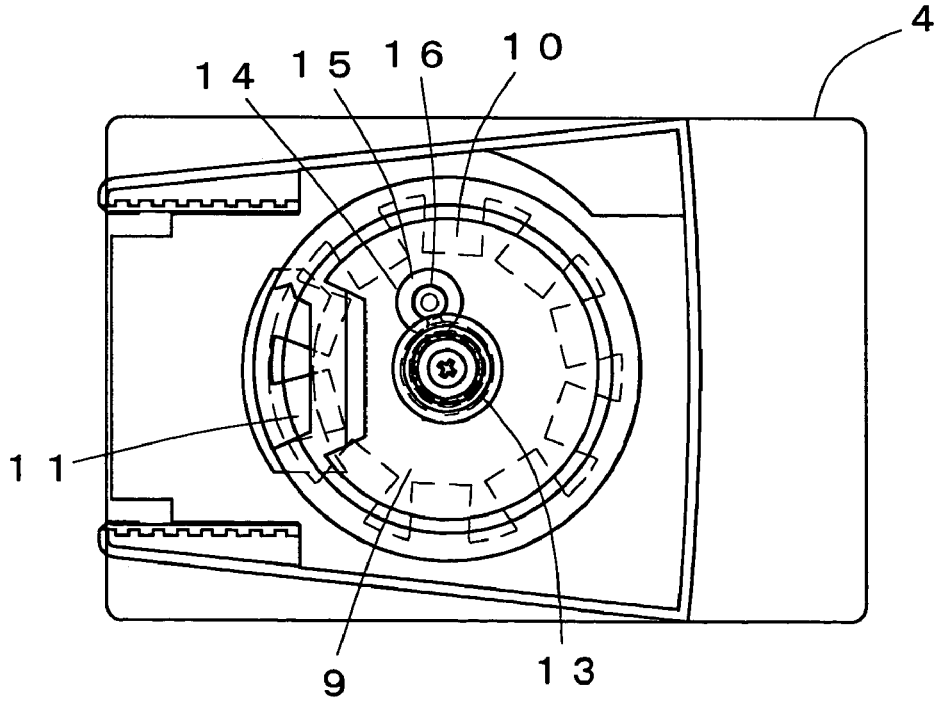
FIG. 5 is a bottom view of the tablet housing case shown in FIG. 4.
Figure 6:
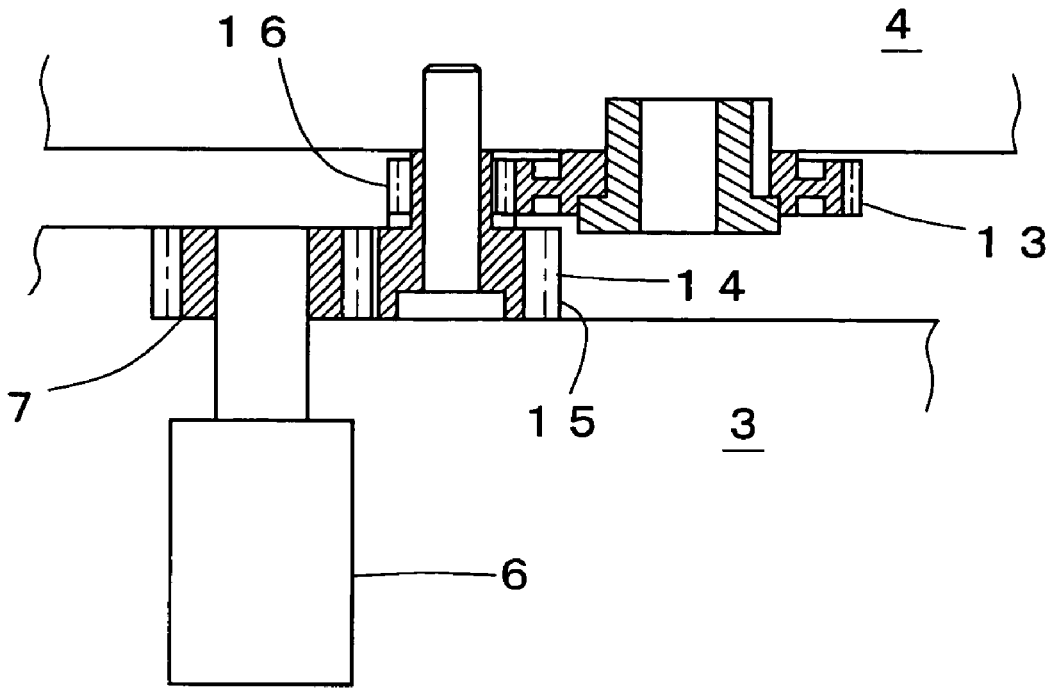
FIG. 6 is a cross sectional view showing gears in a geared state.

As shown in FIG. 4 and FIG. 5, the tablet housing case 4 has a substantially box-like shape and its upper face is comprised of a cover article 8 that is openable and closable. The upper face of the bottom wall of the tablet housing case 4 is shaped into a substantially circular cone, on which a rotor 9 is disposed. On the lower face of the circular cone of the rotor 9, groove-shaped pocket sections 10 are formed in a plurality of locations at an equal angle. The pocket section 10 has a width and a depth that makes it possible to hold only one among the housed tablets. Moreover, a discharge port 11 is formed on the bottom wall of the tablet housing case 4. The discharge port 11 has a width size that makes it possible to position only one pocket section 10 of the rotor 9. The rotating shaft of the rotor 9 protrudes from the lower face of the bottom wall of the tablet housing case 4, and is integrated with a driven gear 13. As the driven gear 13, there is used, for example, a spur gear having 38 teeth. Also on the lower face of the bottom wall of the tablet housing case 4, an intermediate gear 14 is provided in a rotatable manner. As shown in FIG. 6, the intermediate gear 14 is a double-tiered spur gear comprised of a first gear section 15 that gears with the drive gear 7 and a second gear section 16 that gears with the driven gear 13 when the tablet housing case 4 is attached to the case support base 3. The first gear section 15 has the same number of teeth as the drive gear 7, while the second gear section 16 has a number of teeth smaller than that of the driven gear 13 (12 teeth for example).

Description will now be given of the operation of the above-structured tablet feeder 1.

Based on prescription data, a tablet feeder 1 housing relevant tablets is driven. More specifically, the motor 6 is driven to rotate the rotor 9, and the tablet held in each pocket section 10 is discharged in sequence from the discharge pathway 3*a*. A number of discharged tablets is counted by a sensor provided in the discharge pathway 3*a*, and the motor 6 is stopped when a specified number is reached.

Thus, the tablets are dispensed from the tablet feeder 1, and when the tablets run out, the tablet housing case 4 is detached from the case support base 3 for replenishment. Here, since the drive gear 7 gears with the second gear section 16 of the intermediate gear 14, the intermediate gear 14 rotates by one tooth at the maximum. In this connection, the driven gear 13 that is connected to the rotor 9 via the first gear section 15 of the intermediate gear 14 also rotates. In this case, the gear ratio of the second gear section 16 to the first gear section 15 is small, and in addition, a gear ratio of the driven gear 13 to the second gear section 16 is large. Consequently, the rotating angle of the driven gear 13 is kept small. For example, in the case where the drive gear 7 has 13 teeth, the first gear section 15 of the intermediate gear 14 has 13 teeth, the second gear section 16 has 12 teeth, and the driven gear 13 has 38 teeth as described above, one-tooth rotation of the drive gear 7 corresponds to approx. 0.4-tooth (13/12×13/38) rotation of the driven gear 13. Therefore, even if the intermediate gear 14 rotates when the tablet housing case 4 is detached from the case support base 3, the rotating amount of the driven gear 13 can be kept small, and so tablets held in adjacent pocket sections 10 will not be discharged from the discharge pathway 3*a* through the discharge port 11. This means that attachment and detachment of the tablet housing case 4 will not cause an improper fall of the tablets.

It is to be noted that in the aforementioned embodiment, the gear ratio between the first gear section 15 and the second gear section 16 of the intermediate gear 14 and the gear ratio between the second gear section 16 of the intermediate gear 14 and the driven gear 13 are set to be different so as to control rotation of the rotor 9 upon attachment and detachment of the tablet housing case 4. However, it is also acceptable to control the rotation of the rotor 9 with the use of the combination of at least either one of the gear ratios and a gear ratio between the drive gear 7 and the first gear section 15 of the intermediate gear 14. Particularly in the present embodiment, since the double-tiered intermediate gear 14 having a different gear ratio is interposed between the drive gear 7 and the driven gear 13, the rotational quantity of the rotor 9 when the tablet housing case 4 is detached from the case support base 3 in a restricted range of occupied area can be sufficiently suppressed so as to thoroughly prevent a tablet held in the pocket section 10 from falling down to the discharge pathway 3*a* through the discharge port 11.

Second Embodiment

Figure 7:
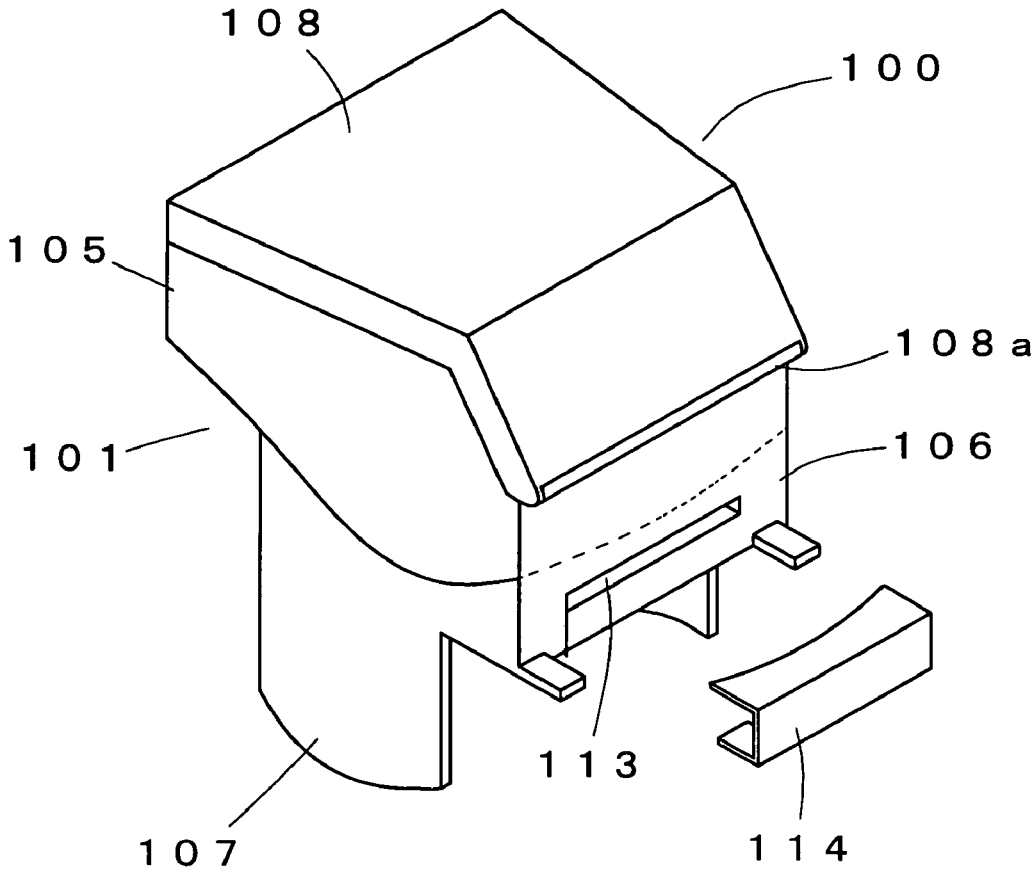
FIG. 7 is a perspective view showing a tablet housing case in a tablet feeder according to a second embodiment.

FIG. 7 shows a tablet feeder 100 according to the second embodiment. Like the first embodiment, the tablet feeder 100 is comprised of a tablet housing case 101 that can be attached to and detached from a case support base 3 provided in a tablet feeding apparatus 2.

Figure 9:
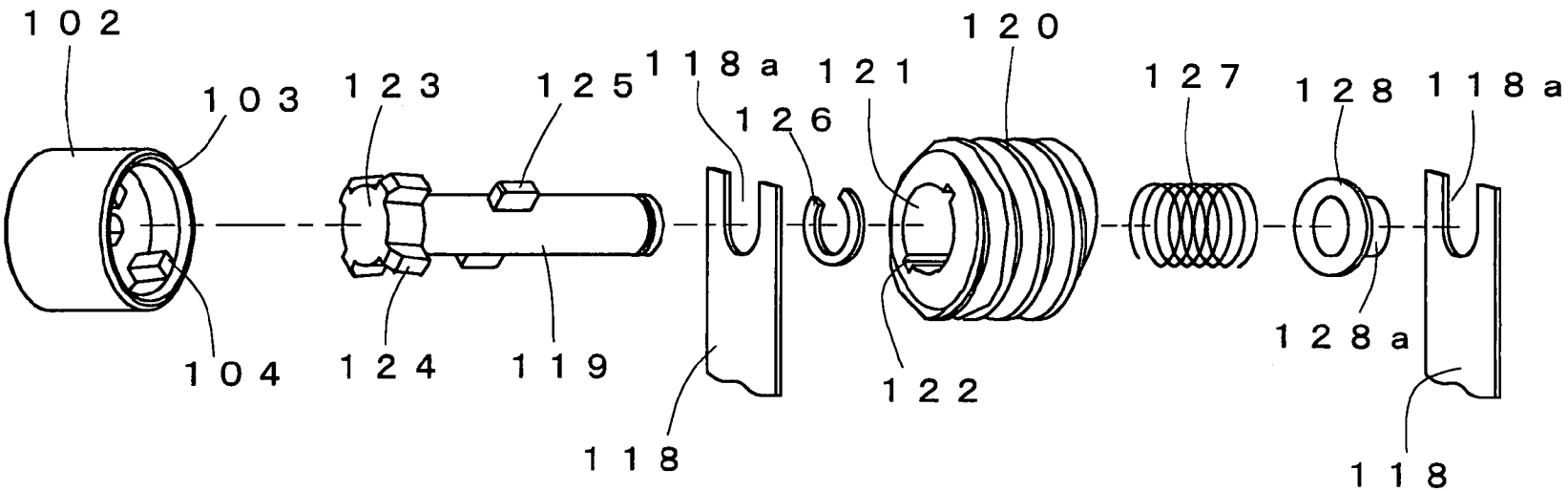
FIG. 9 is an exploded perspective view showing a portion of the tablet housing case adjacent to a worm gear.

On the case support base 3, a rotating shaft of a motor (not shown) protrudes along an attachment direction of the tablet housing case 101, and a drive section 102 shown in FIG. 9 is provided at its top end. The drive section 102 is composed of a cylindrical section 103 formed on the periphery of the top end, and a pair of first engagement protruding sections 104 formed in symmetrical positions on the inner surface thereof.

As shown in FIG. 7, the tablet housing case 101 is comprised of a box-shaped housing section 105, a cylindrical barrel section 106 linked to the lower part of the housing section 105, and an attachment section 107 protruding in a circular arc shape from the outer circumference of the bottom face of the barrel section 106. An upper aperture portion of the housing section 105 is opened and closed by a cover article 108 that rotates around a spindle 108*a*.

Figure 8A:
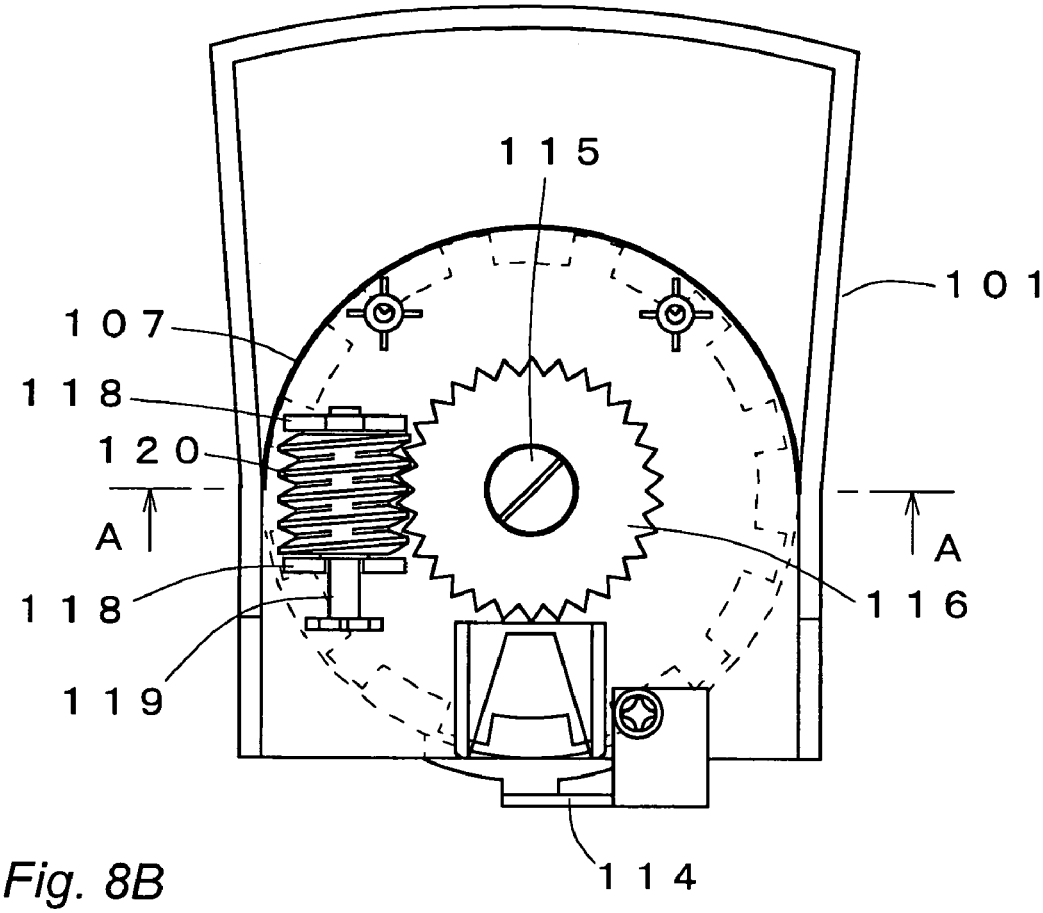
FIG. 8A is a bottom view showing the tablet housing case illustrated in FIG. 7.
Figure 8B:
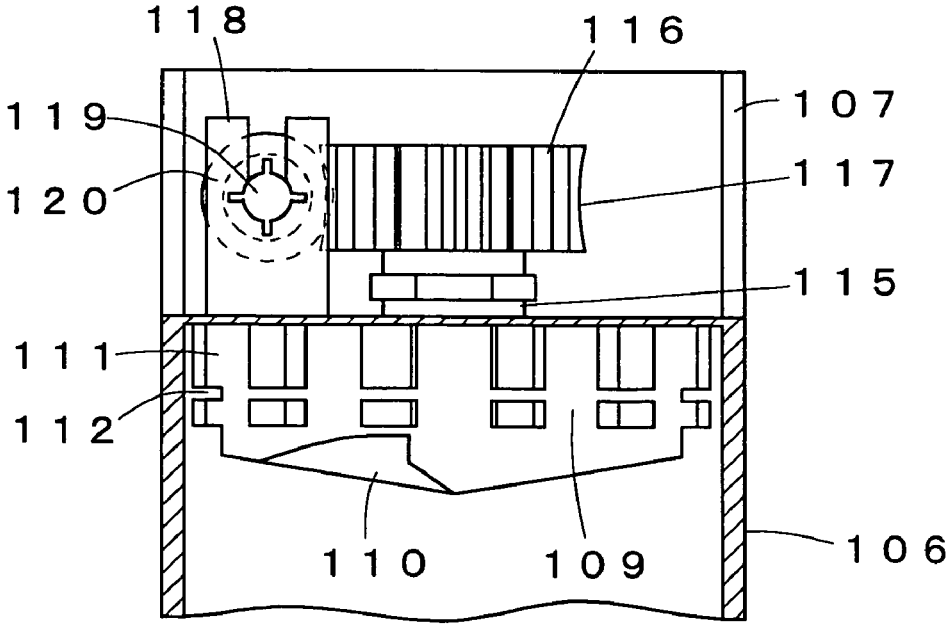
FIG. 8B is a cross sectional view taken along line A—A of FIG. 8A.

As shown in FIG. 8B, a rotor 109 is rotatably housed in the barrel section 106. The rotor 109 is formed to have a circular arc-shaped upper face, on which a recess section 110 forming a fan shape from a vertex and having a depth gradually increased toward the direction of rotation is formed in three locations at an equal angle. On the outer circumferential face of the rotor 109, a groove-shaped pocket section 111 is formed in a plurality of locations at an equal angle. The pocket sections 111 are linked to each other through a circumferential groove 112, on which a partition member 114 is disposed as shown in FIG. 7. The partition member 114 is inserted from a slit 113 formed on the front face of the barrel section 106. The partition member 114 ensures that a pocket section 111 holds only one of the tablets from the housing section 105 by preventing other tablets from the housing section 105 from entering into the pocket section 111. A rotating shaft 115 of the rotor 109 protrudes from the bottom face of the barrel section 106 to the inside of the attachment section 107, where the rotating shaft 115 is integrated with a driven gear 116. A curved recess section 117 is formed on the tooth top of the driven gear 116 to achieve a good gearing condition with a later-described worm gear 120.

On the bottom face of the barrel section 106, as shown in FIG. 7 to FIG. 9, supporting walls 118 are formed with a specified space, which support the worm gear 120 in a rotatable manner through a slide shaft 119. The worm gear 120 gears with the given gear 116, and its center hole 121 has groove portions 122 formed in symmetrical positions. The slide shaft 119 has a collar section 123 on its one end, and second engagement protruding sections 124 are formed at quadrisected positions on the circumference thereof. The collar section 123 is disposed in the cylindrical section 103 formed on the drive section 102 of the motor so that the second engagement protruding sections 124 engage with the first engagement protruding sections 104 formed thereon. Further, projections 125 slidably disposed in the groove portions 122 of the worm gear 120 are formed in the symmetrical positions on a central portion of the slide shaft 119.

The worm gear 120 is attached as described below. That is, a C-ring 126 is slidably placed between the collar section 123 and the projections 125 of the slide shaft 119, and a spring 127 is externally attached on the top end side of the slide shaft 119. Then, the top end side of the slide shaft 119 is inserted together with the spring 127 into the center hole 121 of the worm gear 120, and is passed through a tiered O-ring 128. At this point, the projections 125 of the slide shaft 119 slidably engage with the groove portions 122 of the worm gear 120. Next, a portion between the C-ring 126 and the collar section 123, and a small-diameter section 128*a* of the O-ring 128 are rotatably supported by a U-shaped section 118*a* of the supporting wall 118.

In the case of the above-structured tablet feeder 100, the tablet housing case 101 is attached to the case support base 3, by which the collar section 123 of the slide shaft 119 is positioned in the cylindrical section 103 of the drive section 102, where the first engagement protruding sections 104 engage with the second engagement protruding sections 124, allowing transmission of power from the motor to the rotor 109. In this case, if the positions of the first engagement protruding sections 104 are aligned with the positions of the second engagement protruding sections 124 and so a desired engagement state is not achieved, the slide shaft 119 is pushed against the spring 127. Consequently, the worm gear 120 will not rotate, and so the driven gear 116 and the rotor 109 maintain their positions, preventing a tablet held in the pocket section 111 from accidentally falling down to the side of the pathway 1*a*. Then, when the motor is driven later, the slide shaft 119 rotates and the positions of the first engagement protruding sections 104 with respect to the second engagement protruding sections 124 are displaced, so that the slide shaft 119 is moved by the biasing force of the spring 127, which establishes engagement between the engagement protruding sections 104 and 124, thereby allowing transmission of power.

Further, when the tablet housing case 101 is detached from the case support base 3, the first engagement protruding sections 104 of the drive section 102 impart no power to the second engagement protruding sections 124 of the slide shaft 119, so that the worm gear 120 will not rotate, and so the driven gear 116 and the rotor 109 maintain their position intact. Therefore, if the tablet housing case 101 is detached from the case support base 3, the rotor 109 will not rotate, and so a tablet held in the pocket section 111 will not fall down accidentally.

The invention claimed is:

1. A tablet feeder comprising:

a case support base;

a motor provided in the case support base and having a rotatable shaft;

a tablet housing case having a discharge section;

a rotor disposed in the tablet housing case and having a plurality of pocket sections for receiving and transporting tablets housed in the tablet housing case; and a drive transmission for transmitting power from the motor to the rotor such that tablets housed in the tablet housing case can be moved by operation of the motor to the discharge section of the tablet housing case via the pocket sections of the rotor, and then discharged from the discharge section, wherein the drive transmission comprises:

a driven gear that is interlocked with the rotor;

a worm gear that gears with the driven gear;

a slide shaft that is disposed slidably along a shaft center of the worm gear and rotates integrally with the worm gear, wherein the worm gear and slide shaft are supported in the tablet housing case; and a drive section provided in the case support base, the drive section being integrated with a rotating shaft of the motor and engagable with, and/or disengagable from, one end portion of the slide shaft in an axial direction.

2. The tablet feeder as claimed in claim 1, wherein the slide shaft includes projections that are slidably engagable with groove portions formed on an interior surface of the worm gear.

3. The tablet feeder as claimed in claim 2, further comprising a spring for axially biasing the slide shaft.

* * * * *